US009679728B2

(12) United States Patent
Oosterwal et al.

(10) Patent No.: US 9,679,728 B2
(45) Date of Patent: Jun. 13, 2017

(54) METHODS, APPARATUS AND ARTICLES OF MANUFACTURE TO REGULATE RELAY COIL SWITCHING

(71) Applicant: Whirlpool Corporation, Benton Harbor, MI (US)

(72) Inventors: Erik Peter Oosterwal, Dowagiac, MI (US); Peter J. Richmond, Berrien Springs, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 364 days.

(21) Appl. No.: 14/452,780

(22) Filed: Aug. 6, 2014

(65) Prior Publication Data

US 2016/0042901 A1 Feb. 11, 2016

(51) Int. Cl.

| | |
|---|---|
| ***H01H 47/00*** | (2006.01) |
| ***H01H 50/86*** | (2006.01) |
| ***H01H 9/56*** | (2006.01) |
| ***H01H 47/22*** | (2006.01) |
| ***H01H 7/16*** | (2006.01) |

(52) U.S. Cl.

CPC ..... *H01H 50/86* (2013.01); *H01H 7/16* (2013.01); *H01H 9/56* (2013.01); *H01H 47/22* (2013.01); *H01H 47/223* (2013.01); *H01H 2231/012* (2013.01)

(58) Field of Classification Search

CPC ..... H01H 50/86
USPC ..... 361/186
See application file for complete search history.

(56) References Cited

U.S. PATENT DOCUMENTS

| | | | |
|---|---|---|---|
| 5,644,463 | A | 7/1997 | El-Sharkawi et al. |
| 5,804,991 | A | 9/1998 | Hu |
| 5,808,851 | A | 9/1998 | Birrell |
| 6,768,615 | B2 | 7/2004 | Liu |

(Continued)

FOREIGN PATENT DOCUMENTS

| | | |
|---|---|---|
| EP | 0353986 A3 | 2/1990 |
| EP | 1006539 A1 | 6/2000 |

(Continued)

OTHER PUBLICATIONS

European Patent Application No. 15179561.4 filed Aug. 3, 2015. Applicant: Whirlpool Europe, Srl, European Extended Search Report re: same, mail date Jan. 13, 2016.

*Primary Examiner* — Stephen W Jackson

(57) ABSTRACT

Methods, apparatus, and articles of manufacture to regulate relay coil switching are disclosed. A disclosed example method of regulating switching times of a relay having a pair of contacts to selectively and electrically couple an analog alternating current (AC) power source and a load includes forming a digital pulse train representative of an AC signal at the load, determining a first value corresponding to a representative pulse width of the digital pulse train, providing a first relay switching signal to the relay at a first time relative to a zero crossing of the AC signal, selecting a second time for providing a second relay switching signal to the relay based the first value and a second value representative of the width of a first pulse of the digital pulse train associated with the first relay switching signal at the first time, and providing the second relay switching signal to the relay at the second time.

18 Claims, 12 Drawing Sheets

(56) References Cited

U.S. PATENT DOCUMENTS

| | | | | |
|---|---|---|---|---|
| 8,154,841 | B2 | 4/2012 | Allen et al. | |
| 8,441,248 | B2 | 5/2013 | Kachorek et al. | |
| 8,467,164 | B2 | 6/2013 | Elwell et al. | |
| 9,006,616 | B2 * | 4/2015 | Nicholson | H05B 1/025 219/492 |
| 2008/0258692 | A1 | 10/2008 | Heinz et al. | |
| 2012/0262147 | A1 | 10/2012 | Wang | |
| 2013/0057998 | A1 | 3/2013 | Li et al. | |

FOREIGN PATENT DOCUMENTS

| | | | |
|---|---|---|---|
| FR | 2791466 | A1 | 9/2000 |
| WO | 2009135519 | A1 | 11/2009 |

* cited by examiner

METHODS, APPARATUS AND ARTICLES OF MANUFACTURE TO REGULATE RELAY COIL SWITCHING

FIELD OF THE DISCLOSURE

This disclosure relates generally to relays, and, more particularly, to methods, apparatus, and articles of manufacture to regulate relay coil switching.

BACKGROUND

Some traditional appliances, such as ovens, stoves, ranges, and clothes dryers have relays that are operated to control the supply of power to high-current and/or high-voltage components, such as heating elements.

SUMMARY

A disclosed example method of regulating switching times of a relay having a pair of contacts to selectively and electrically couple an analog alternating current (AC) power source and a load includes forming a digital pulse train representative of an AC signal at the load, determining a first value corresponding to a representative pulse width of the digital pulse train, providing a first relay switching signal to the relay at a first time relative to a zero crossing of the AC signal, selecting a second time for providing a second relay switching signal to the relay based the first value and a second value representative of the width of a first pulse of the digital pulse train associated with the first relay switching signal at the first time, and providing the second relay switching signal to the relay at the second time.

DETAILED DESCRIPTION

Figure 1:
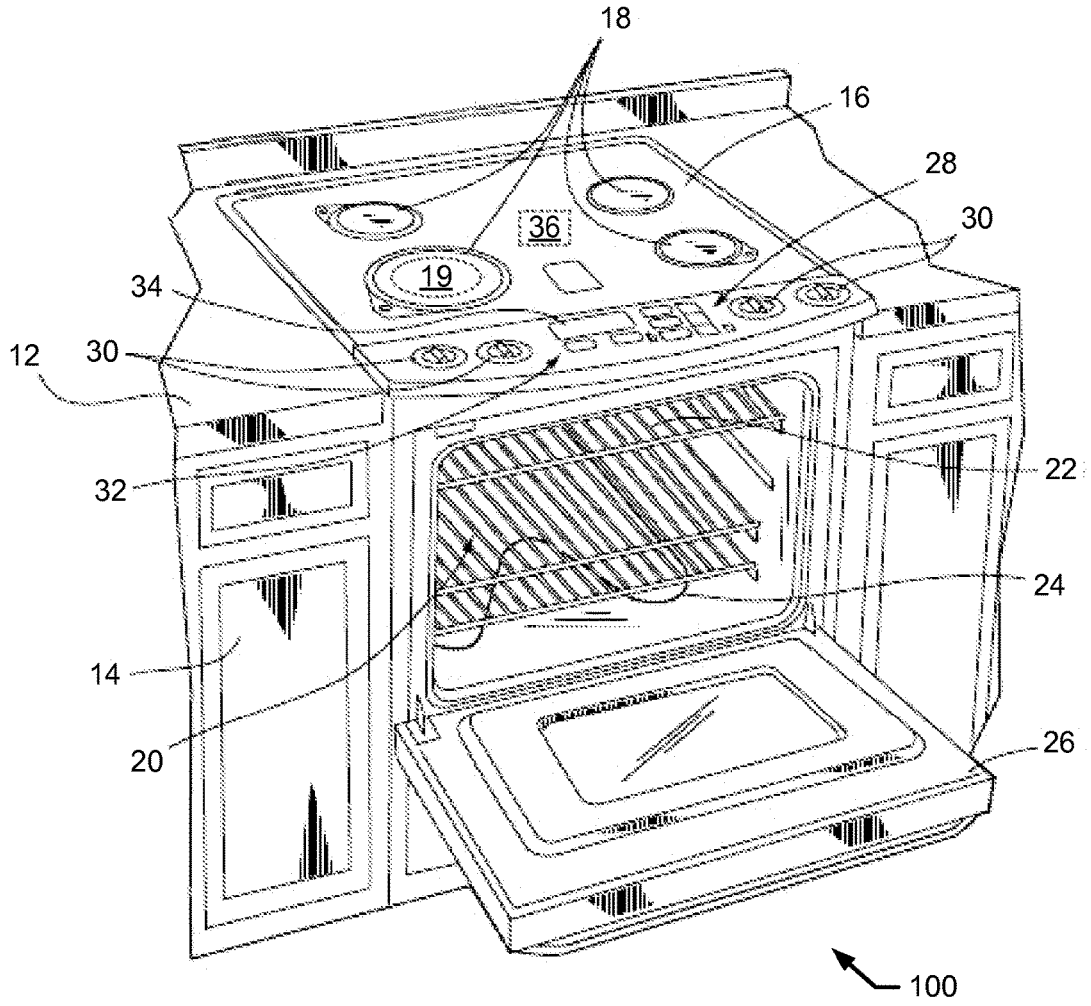
FIG. 1 is a schematic view of an example appliance in the form of a built-in electric range including relay coil switching regulation and control in accordance with the teachings of this disclosure.

In this specification and the appended claims, the singular forms "a," "an" and "the" do not exclude the plural referent unless the context clearly dictates otherwise. Further, conjunctions such as "and," "or," and "and/or" are inclusive unless the context clearly dictates otherwise. For example, "A and/or B" includes A alone, B alone, and A with B. Further still, connecting lines, or connectors shown in the various figures presented are intended to represent exemplary functional relationships and/or physical or logical couplings between the various elements. It should be noted that many alternative or additional functional relationships, physical connections or logical connections may be present in a practical device. Additionally, no item or component is essential to the practice of the embodiments disclosed herein unless the element is specifically described as "essential" or "critical". Moreover, terms such as, but not limited to, approximately, substantially, etc. are used herein to indicate that a precise value is not required, need not be specified, etc. For example, a first value being approximately a second value means that from a practical implementation perspective they can be considered as if equal. As used herein, such terms will have ready and instant meaning to one of ordinary skill in the art.

Relay contact life may degrade when high-current loads are switched on and/or off when there is a large voltage potential across the contacts. The problem is worse when the current passing through the contacts is at or above the rated current handling of the relay. Example degradations include fused contacts, pitted contacts, carbon encrusted contacts, etc. Example prior art solutions include use of a zero-cross detection circuit to switch at zero-cross, and a walking pattern algorithm that attempts to perform switching randomly at different voltage potentials. The former solution does not always work correctly for 3-phase systems, and without feedback cannot verify or ensure that switching times are correct. Without means to verify switching time, performance degrades overtime. The latter solution only partially resolves the problem as switching still occurs occasionally under large voltage potential conditions. Moreover, the characteristics of relays change with time, temperature, usage, etc. It will be understood that relays do not close and open instantaneously due to, for example, mechanical effects, inertia and, may experience closure bounce due to spring effects.

To overcome at least these problems, the methods, apparatus and articles of manufacture to regulate and/or control relay coil switching times disclosed herein perform an initial calibration, and then adaptively adjust over time relay coil switching times to maintain relay coil switching at or near a desired time relative to zero crossings of the power supply. An example desired time for initiating relay operate (i.e., relay contact closure) is to straddle zero-cross with the relay operate. An example desired time for relay operate initiation is within +/−1 milliseconds (ms) of zero-cross, assuming it takes approximately 1 ms to close the relay. An example desired time for initiating relay release (i.e., relay open) is to initiate opening the relay before zero-cross to avoid flash effects due to increasing voltage as the contacts open. An example desired time is to initiate relay release is 1 to 2 ms before zero-cross. Of course, the methods, apparatus, and articles of manufacture to regulate and/or control relay coil switching disclosed herein may be used to control relay switching to occur at other times relative to zero-cross.

An example relay calibration process uses an L1–N (line 1 minus neutral) zero-cross signal to time the relay coil switching signal, and reads the feedback signal from the relay contact output to measure how long it takes to close and open a relay. An example feedback signal is a pulse train formed by comparing L1–N to a threshold such that, for example, when the L1–N signal exceeds the threshold the pulse train is logic high or TRUE, and when the signal does not exceed the threshold the pulse train is logic low or FALSE. The threshold is typically non-zero due to transistor switching voltage, etc. The feedback signal is a pulse train due to the periodicity of L1–N (see FIG. 3). During calibration, relay switching signals sent to each relay being controlled are adjusted so that the relay contacts are closed and opened in or near the middle of the feedback signal pulse, thereby allowing a reasonably accurate measurement of each relay's contact opening and closing durations. In some examples, the initial relay calibration process is performed during manufacturing and/or on initial startup. The initial relay calibration process may be repeated or performed at other times, however, calibration relay switching when an appliance is not in operation may be perceived negatively by some persons.

An example adaptive adjustment process uses the relay contact output feedback signal to make adjustments to the switching trigger times during normal operation. In an example, the process uses a modified line-straddling algorithm to adapt switching times so that relay contacts close near zero-cross +/−1 ms, and open 1-2 ms before zero-cross. If the relay contact is closed or opened too early, the time at which the next corresponding relay switch signal is sent to the relay is moved forward in time with respect to zero-cross. If the relay contact is closed or opened too late, the time at which the next corresponding relay switch signal is sent to the relay is moved back in time with respect to zero-cross.

In some examples, the example methods, apparatus and articles of manufacture disclosed herein uses L1–N and L2–N (line 2 minus neutral) zero-cross signals to determine whether an AC power source is a split-single phase or three-phase source. When a three-phase power source is present and not accommodated for, switching will not occur at L1–L2 zero-cross. Thus, if a three-phase source is identified, the examples disclosed herein determine whether L1 leads or follows L2. The results are used to adjust relay switching times so that switching is done when the L1–L2 AC voltage across the relay contacts is at or near zero-cross.

FIG. 1 illustrates an example built-in electric range 10 having relay coil switching regulation and/or control in accordance with the teachings of this disclosure. The example range 10 described herein shares many features of a traditional range, which will not be described except as necessary for a complete understanding of this disclosure. Although the range 10 illustrated in FIG. 1 is a built-in range, that is, a range built into a countertop 12 and/or cabinets 14 of, for example, a kitchen or food preparation area, the range 10 may alternatively be embodied as a freestanding range. Moreover, while the examples disclosed herein are described with reference the range 10, it should be understood that the example relay coil switching regulation and/or control methods, apparatus and articles of manufacture disclosed herein may be a part of and/or be used in association with any number and/or type(s) of other appliances such as, but not limited to, a gas range, a gas/electric range, a cooktop, a laundry dryer, a laundry washer, a dishwasher, a refrigerator, a freezer, a heat pump, an air conditioner, and a water heater, and/or any other device and/or apparatus in which relays are used to control electrical coupling between power supply and load.

The example range 10 of FIG. 1 has a glass-ceramic cooktop 16 including one or more cooking areas 18. However, other types of cooktops may be used. A radiant heating element, one of which is designated at reference numeral 19, is positioned below each of the cooking areas 18. The example range 10 includes an oven 20 having one or more racks 22 for positioning items in the oven 20, and one or more heating elements 24. The range 10 includes a door 26 moveably mounted to the range 10 that is selectively movable between opened and closed positions to close an opening of the oven 20, thereby providing selective access to the interior of the oven 20.

To enable a user to control operation of the range 10, the range 10 includes a control panel 28. To control operation of the heating elements 19, the example control panel 28 includes respective knobs 30. However, other means of controlling the heating elements 19, such as capacitive touch areas, buttons, etc. may be used. To control other operations of the range 10 such as, but not limited to, oven temperature, timer, cook time, time of day, etc., the range 10 includes one or more control areas 32 and/or one or more display areas 34. Any number and/or type(s) of elements, devices and/or technologies may be used to implement the control area(s) 32 and the display area(s) 34. For example, capacitive touch areas may be used to implement the control area(s) 32, and liquid crystal display (LCD) or light emitting diode (LED) display technologies may be used to implement the display area(s) 34.

Figure 19:
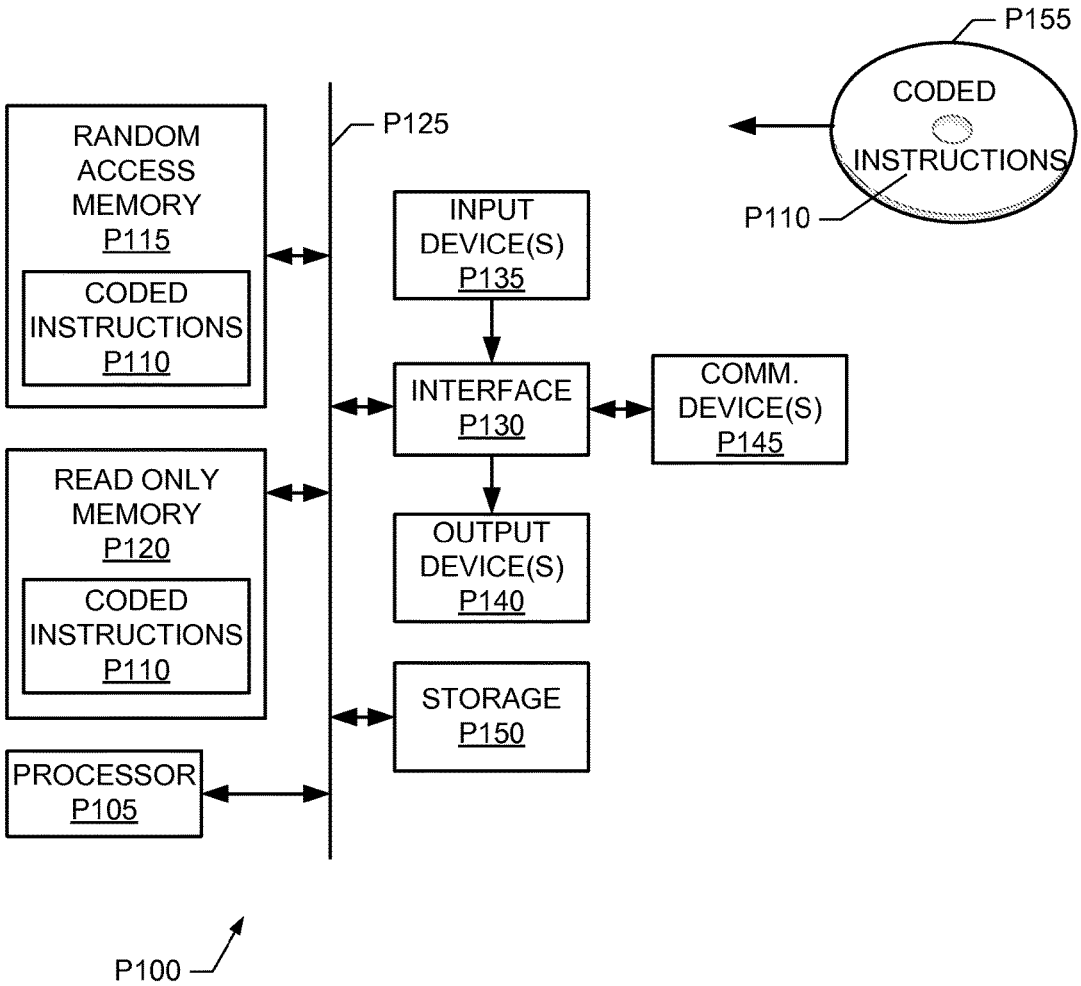
FIG. 19 is a schematic illustration of an example processor platform that may be used and/or programmed to implement the example relay control system of FIG. 2 and/or to execute the example methods disclosed herein.

To control operation of the range 10, the range 10 includes a controller 36, which may be implemented by, for example, the example processor platform P100 of FIG. 19. The controller 36 controls operation of the range 10 in response to user inputs received via the knobs 30 and/or the control area(s) 32. For example, the controller 36 controls on and off states of the heating elements 19, 24 to maintain desired temperatures. Power is coupled to the heating elements 19, 24 via respective relays 212 and 214 (see FIG. 2). The controller 36 controls on and off states of the heating elements 19, 24 by regulating or controlling relay switching, that is, releasing (i.e., opening) and operating (i.e., closing) the relays 212, 214.

The example controller 36 has a central processing unit (CPU) P105 and memory P115, P120 (see FIG. 19). The memory P115, P120 may be used to store control software that is executed by the CPU P105 in regulating and/or controlling relay switching. The controller 36 is operably coupled with one or more components P135, P140 of the range 10 for communicating with and controlling the operation of the components P135, P140 to complete a cycle of operation. Non-limiting examples of components P135, P140 that may be communicably coupled with the controller 36 include a relay 212, 214 (see FIG. 2). The controller 36 may also be coupled with one or more sensors P135 provided in one or more of the systems of the range 10 to receive input from the sensors P135, which are known in the art and not shown for simplicity. Non-limiting examples of sensors P135 that may be communicably coupled with the controller 36 include a temperature sensor, a sensor circuit 216, 218 (see FIG. 2), and a reference circuit 220, 222.

Figure 2:
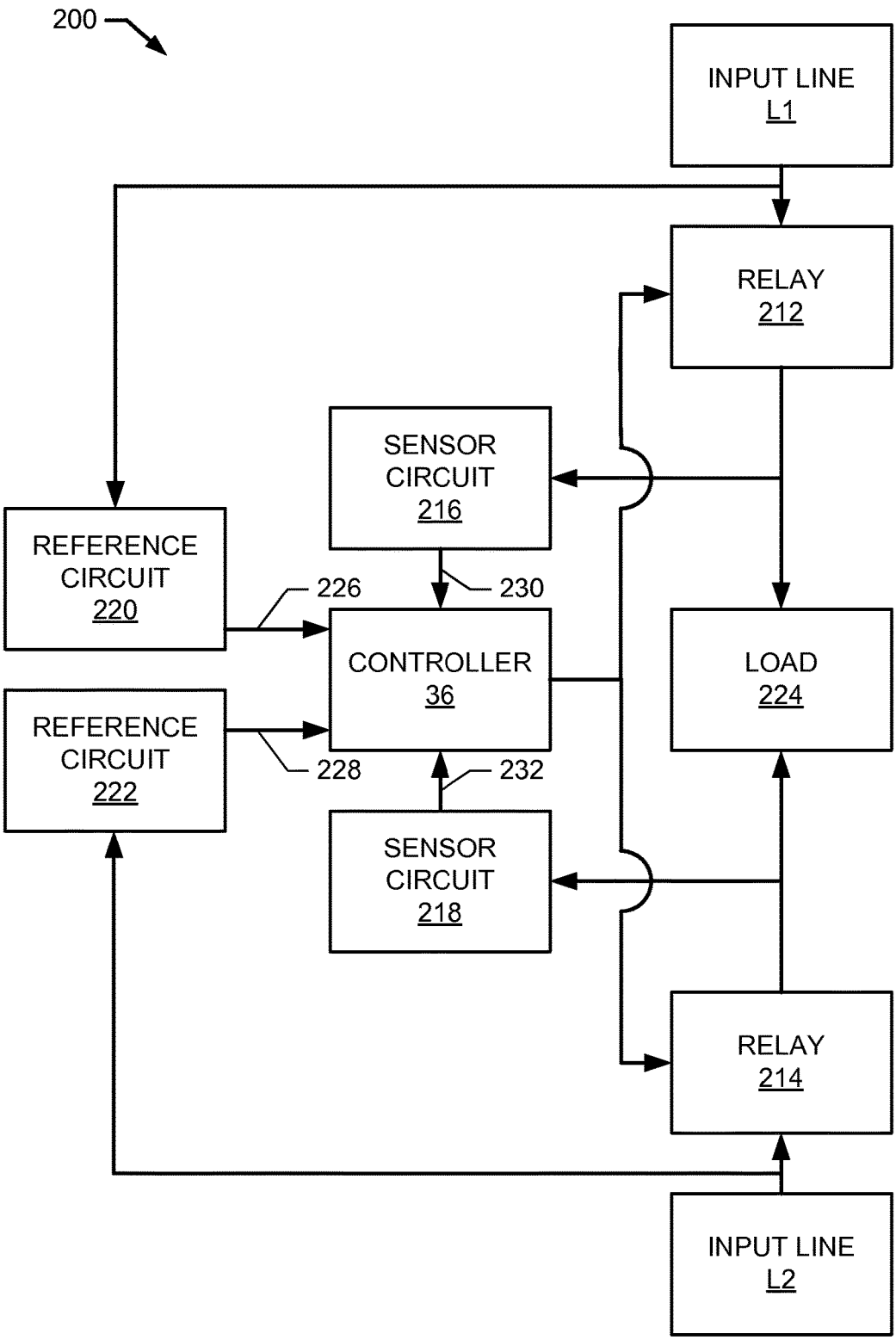
FIG. 2 is a schematic of a disclosed example relay control system for an appliance such as the example range of FIG. 1.

FIG. 2 illustrates an example relay switching control system 200 that may be used to control and/or regulate relay switching for the example range 10 of FIG. 1. The example relay switching control system 200 of FIG. 2 maintains relay coil switching at or near desired times relative to zero crossings of an AC power supply signal received via input lines L1 and L2. The lines L1 and L2 are selectively and electrically coupled to a load 224 via respective relays 212, 214.

To provide reference signals 226, 228 that represent zero crossings of the L1 and L2 input signals, the example relay switching control system 200 includes the respective reference circuits 220, 222. The reference signals 226, 228 are pulse trains formed by comparing respective L1–N, L2–N signals to a threshold such that, for example, when the L1–N signal exceeds the threshold the pulse train 226 is logic high or TRUE, and when the L1–N signal does not exceed the threshold the pulse train 226 is logic low or FALSE. The pulse train 228 is similarly formed. The threshold is typically non-zero due to transistor switching voltage, etc. An example L1–N signal and corresponding reference signal pulse train 226 are shown in the example graph of FIG. 3. The reference signals 226, 228 are pulse trains due to the generally periodic nature of L1–N and L2–N (see FIG. 3).

Figure 5:
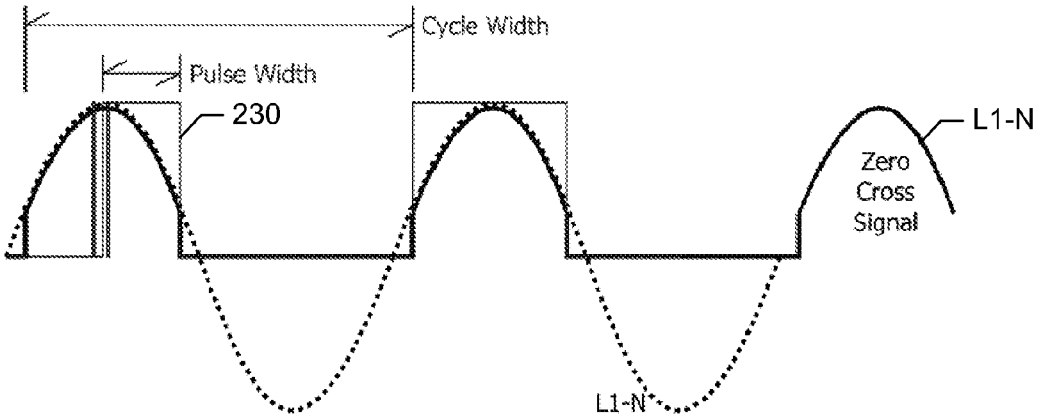
FIGS. 5-7 are graphs depicting example pulse widths corresponding to different relay operate times.

To provide sensor signals 230, 232 that represent zero crossings of the L1 and L2 input signals gated by the open and closed states of the relays 212, 214, the example relay switching control system 200 includes the respective sensor circuits 216, 218. The sensor signals 230, 232 are pulse trains formed by comparing respective gated L1–N, L2–N signals to a threshold such that, for example, when the gated L1–N signal exceeds the threshold the pulse train 230 is a logic high or TRUE, and when the gated L1–N signal does not exceed the threshold the pulse train 230 is a logic low or FALSE. The sensor signal 232 is similarly formed. The threshold is typically non-zero due to transistor switching voltage, etc. An example L1–N signal and corresponding sensor signal pulse train 230 are shown in the example graph of FIG. 5. In FIG. 5, the first pulse of the pulse train 230 is shortened because the relay 212 is closed during the positive going portion of the L1–N signal. The sensor signals 230, 232 are pulse trains due to the generally periodic nature of L1–N and L2–N signals (see FIG. 5). However, as shown in FIG. 5, the pulse trains 230, 232 may have varying pulse widths due to varying relay switching times.

In some examples, the signals 226, 228, 230 and 232 are sampled at a rate of 4 kHz (kilocycles per second), however, other sample rates may be used. For an AC power source operating nominally at 60 Hz (cycles per second) there are approximately 67 samples per cycle of the L1–N and L2–N signals.

Figure 4:
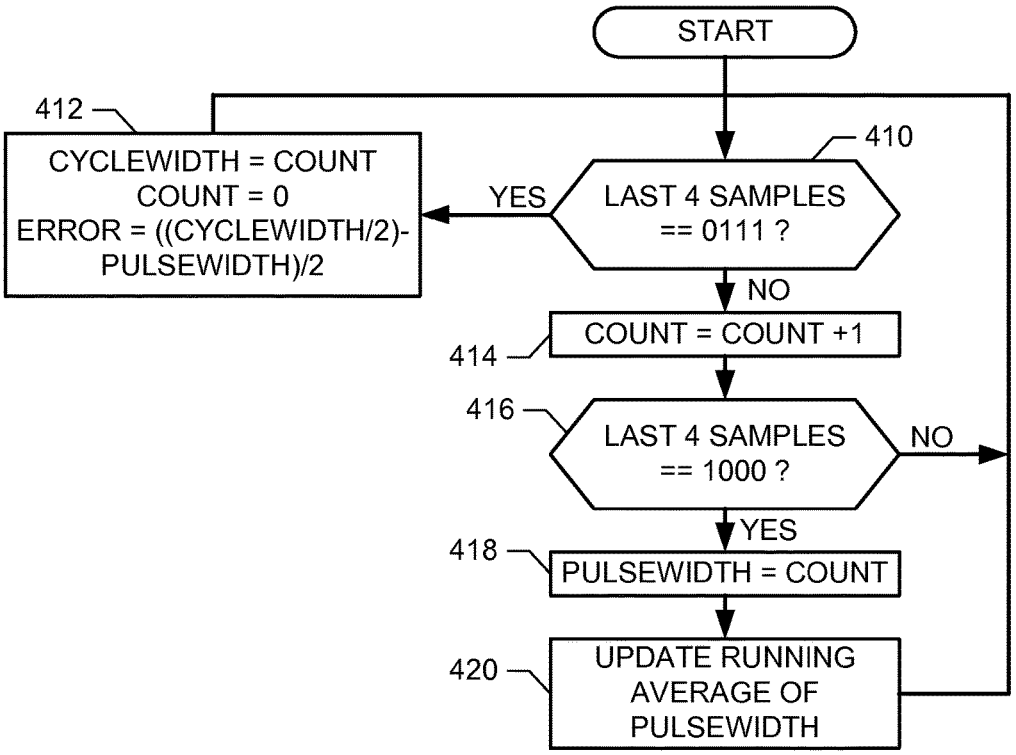
FIG. 4 is a flowchart illustrating an example method that may be performed to estimate an average cycle width and pulse width for the example pulse train of FIG. 3.

As part of an initial calibration, the controller 36 determines a first value corresponding to a representative pulse width of the reference pulse train 226, and a second value corresponding to a representative cycle width of the reference pulse train 226. FIG. 4 is a flowchart illustrating an example method that may be performed and/or carried out by, for example, the processor 36, to determine the first and second values. In the example of FIG. 4, the first value is computed as a moving or running average, and the second value is a counted value. However, additional and/or alternative methods of computing or determining the first and second values may be implemented. In some examples, the method of FIG. 4 continues to be performed beyond initial calibration. In the examples disclosed herein, the reference pulse train 226 is also used to detect or determine zero-cross times, which will be used in the methods described below to determine relay trigger times.

Figure 3:
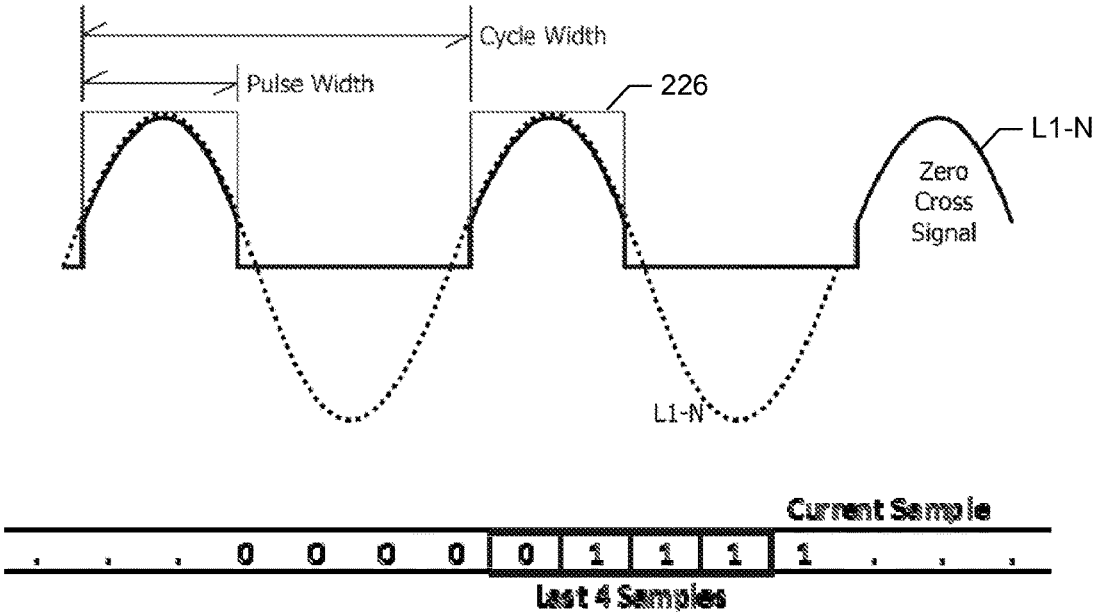
FIG. 3 is a graph depicting an example AC signal and corresponding pulse train.

In the example of FIGS. 3 and 4, the last four (4) samples of the reference signal 226 are used to detect rising and falling edges of the reference signal 226. In particular, last 4 samples of [0111] is indicative of a rising edge, and [1000] is indicative of a falling edge.

The example method of FIG. 4 begins with the controller 36 comparing the last 4 samples to [0111] (block 410). If the last 4 samples are [0111] (block 410), the controller 36 saves COUNT as CYCLEWIDTH, resets COUNT to zero (0), and sets the value of ERROR to, for example, ((CYCLEWIDTH/2)–PULSEWIDTH)/2 (block 412). Control then returns to block 410.

Returning to block 410, if the last 4 samples are not [0111] (block 410), the controller 36 increments COUNT (block 414). If the last 4 samples are [1000] (block 416), the controller 36 saves COUNT as PULSEWIDTH (block 418), and updates a running or moving average of PULSEWIDTH (block 420). Control then returns to block 410.

Returning to block 416, if the last 4 samples are not [1000] (block 416), control returns to block 410.

Initial calibration continues with a determination of operate and release times that result in a PULSEWIDTH of a pulse associated with a relay switch event that is approximately half the average PULSEWIDTH computed or determined by, for example, using the example method of FIG. 4. Because the sensor signals 230, 232 are gated and thresholded, targeting half the average PULSEWIDTH allows greater visibility into relay operate or release times that occur early or late. Other targets may be used.

Figure 6:
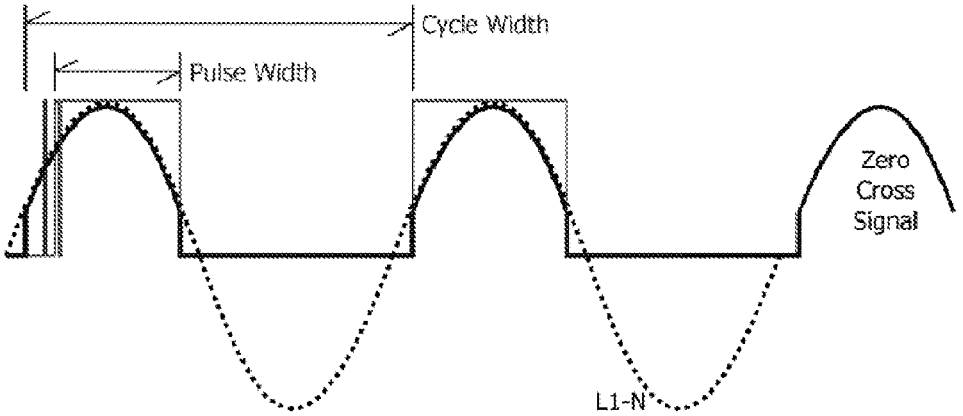
Figure 7:
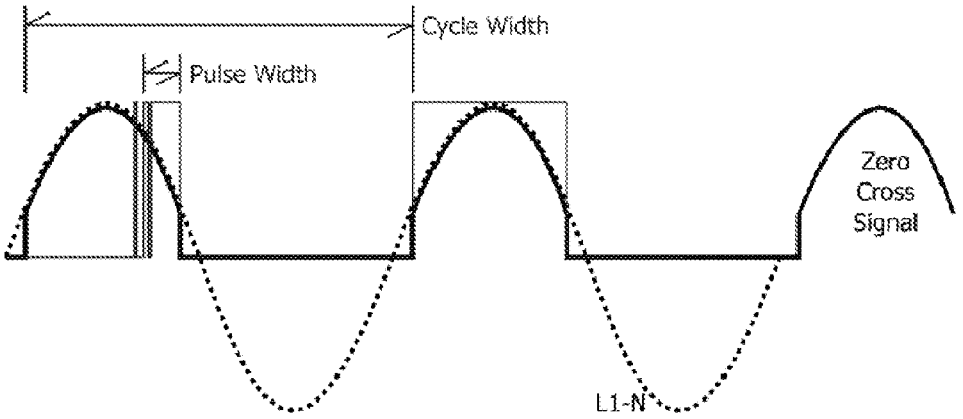

Turning first to relay operate trigger time, FIG. 5 is a graph illustrating an example relay operate event that occurs approximately midway in the positive going portion of the L1–N signal. That is, in the example of FIG. 5, relay operate is occurring at or near the desired time. FIG. 6 is a graph illustrating an example relay operate event that is early. FIG. 7 is a graph illustrating an example relay operate event that is late.

Figure 8:
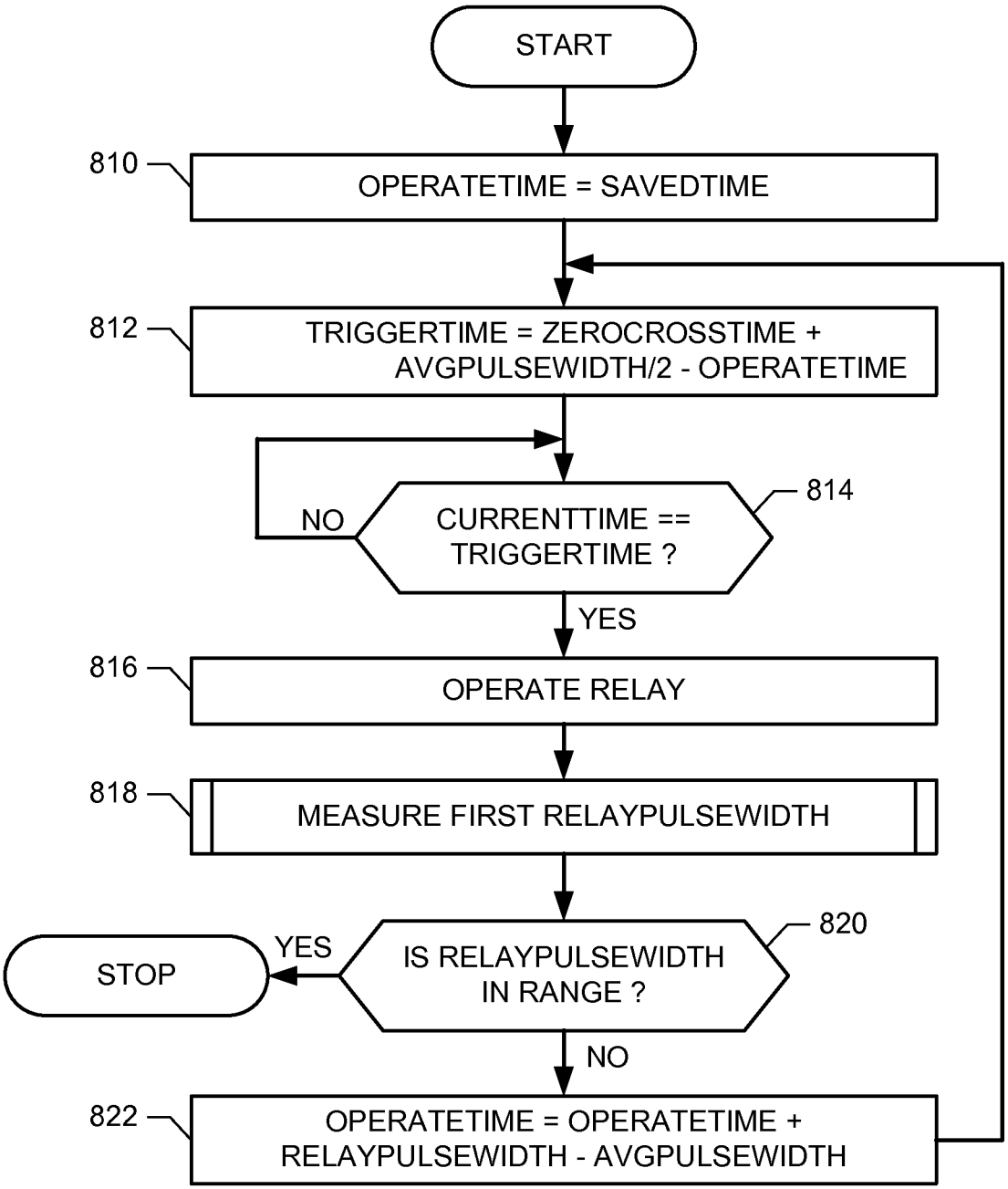
FIG. 8 is a flowchart illustrating an example method that may be performed to determine a desired relay operate time.

FIG. 8 is a flowchart illustrating an example method that may be performed or carried out by, for example, the processor 36, to determine a desired relay operate trigger time. The method of FIG. 8 begins with processor 36 setting OPERATETIME to SAVEDTIME (block 810), where OPERATETIME is the estimated time it takes the relay 212 to close. The processor 36 sets TRIGGERTIME equal to ZEROCROSSTIME+AVGPULSEWIDTH/2–OPERATETIME (block 812), where AVGPULSEWIDTH is determined using, for example, the method of FIG. 4, and ZEROCROSSTIME is determined using the reference signal 226.

When the TRIGGERTIME is reached (block 814), the controller 36 operates the relay 212 (i.e., sends a relay operate switching signal to the relay 212) (block 816), and measures the width of the first pulse following the relay switching signal (block 818). If the measured RELAYPULSEWIDTH is in range (block 820), control exits from the example method of FIG. 8. In range may be determined by, for example, comparing RELAYPULSEWIDTH and ½ of AVGPULSEWIDTH using a threshold.

Returning to block 820, if the RELAYPULSEWIDTH is not in range (block 820), the controller 36 updates OPERATETIME (block 822), and control returns to block 812 to trigger the relay 212 again.

Figure 9:
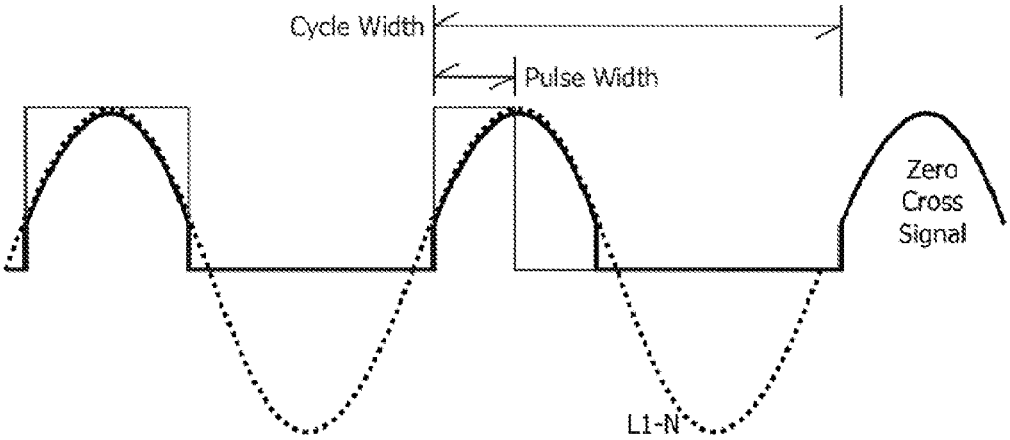
FIGS. 9-11 are graphs depicting example pulse widths corresponding to different relay release times.
Figure 10:
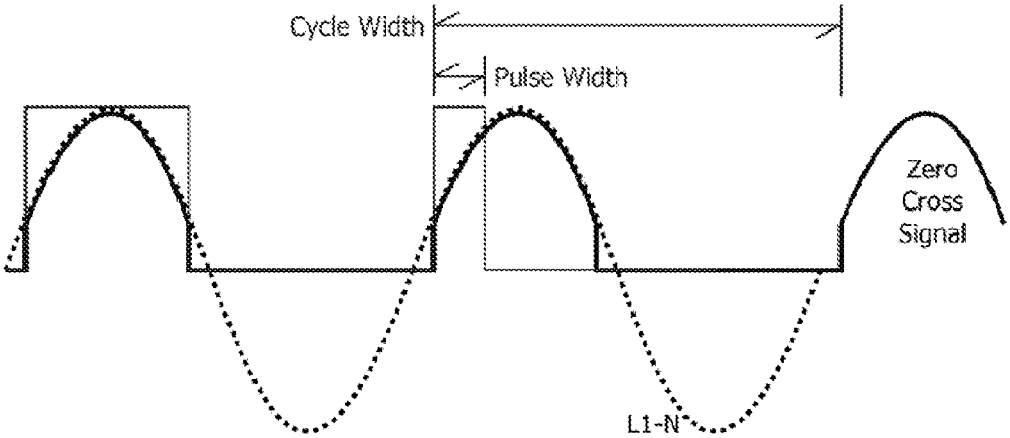
Figure 11:
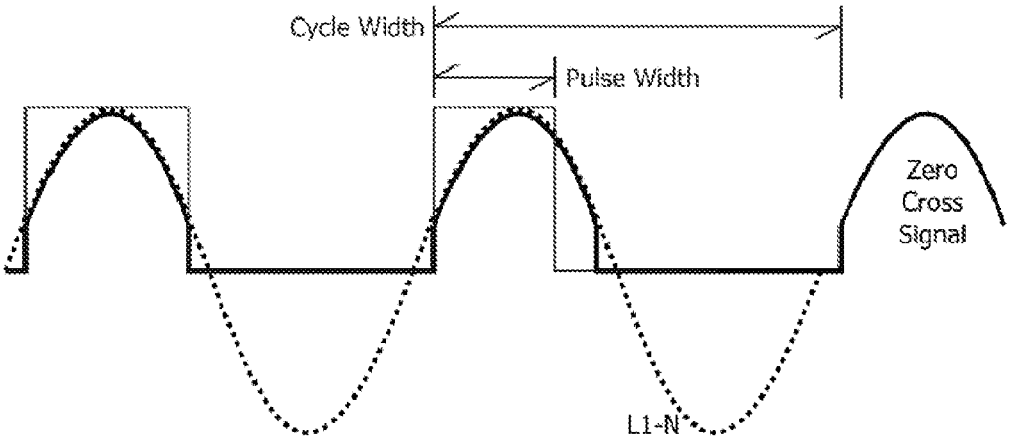

Turning now to relay release trigger time, FIG. 9 is a graph illustrating an example relay release event that occur approximately midway in the positive going portion of the L1–N signal. That is, the example of FIG. 9, relay release is occurring at or near the desired time. FIG. 10 is a graph illustrating an example relay release event that is early. FIG. 11 is a graph illustrating an example relay release event that is late.

Figure 12:
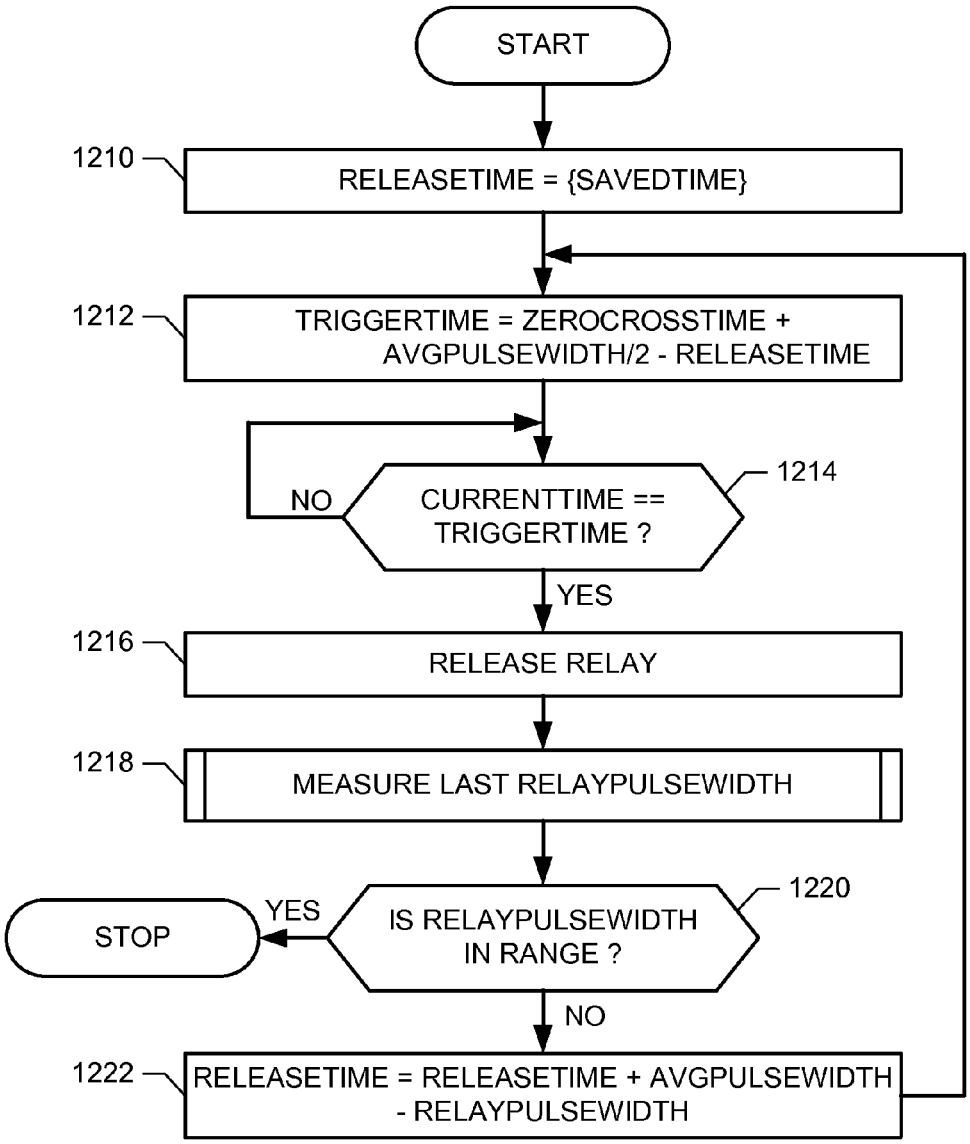
FIG. 12 is a flowchart illustrating an example method that may be performed to determine a desired relay release time.

FIG. 12 is a flowchart illustrating an example method that may be performed or carried out by, for example, the processor 36, to determine a desired relay release trigger time. The method of FIG. 12 begins with processor 36 setting RELEASETIME to SAVEDTIME (block 1210), where RELEASETIME is the estimated time it takes the relay 212 to open. The processor 36 sets TRIGGERTIME to ZEROCROSSTIME+AVGPULSEWIDTH/2–RELEASETIME (block 1212), where AVGPULSEWIDTH is determined using, for example, the method of FIG. 4, and ZEROCROSSTIME is determined using the reference signal 226.

When the TRIGGERTIME is reached (block 1214), the controller 36 releases the relay 212 (i.e., sends a relay release switching signal to the relay 212) (block 1216), and measures the width of the pulse preceding the relay switching signal (block 1218). If the RELAYPULSEWIDTH is in range (block 1220), control exits from the example method of FIG. 12. In range may be determined by, for example, comparing RELAYPULSEWIDTH and ½ of AVGPULSEWIDTH using a threshold.

Returning to block 1220, if the RELAYPULSEWIDTH is not in range (block 1220), the controller 36 updates the RELEASETIME (block 1222), and control returns to block 1212 to trigger the relay 212 again.

Figure 13:
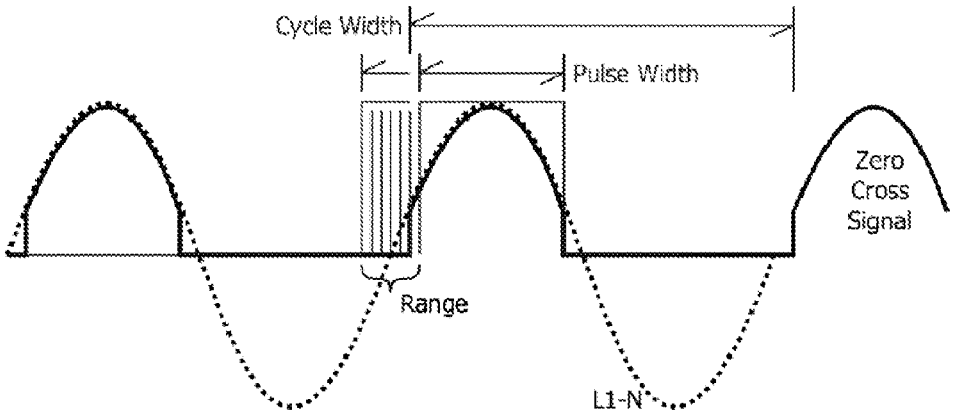
FIG. 13 is a graph depicting example updates of relay operate times during operation.

Subsequent to initial calibration, an example adaptive adjustment process uses the relay contact output feedback signal 230 to make adjustments to relay switching trigger times during operation. For relay operate, the process uses a modified line-straddling algorithm to adapt relay operate trigger time so that relay contacts close near to zero-cross +/−1 ms. If the relay contacts close too early as shown in FIG. 13, the time at which the next corresponding relay operate trigger signal is sent to the relay 212 is moved forward in time with respect to zero-cross. Thus, the relay operate trigger time will progressively move forward in time until the relay closure straddles zero-cross.

Figure 14:
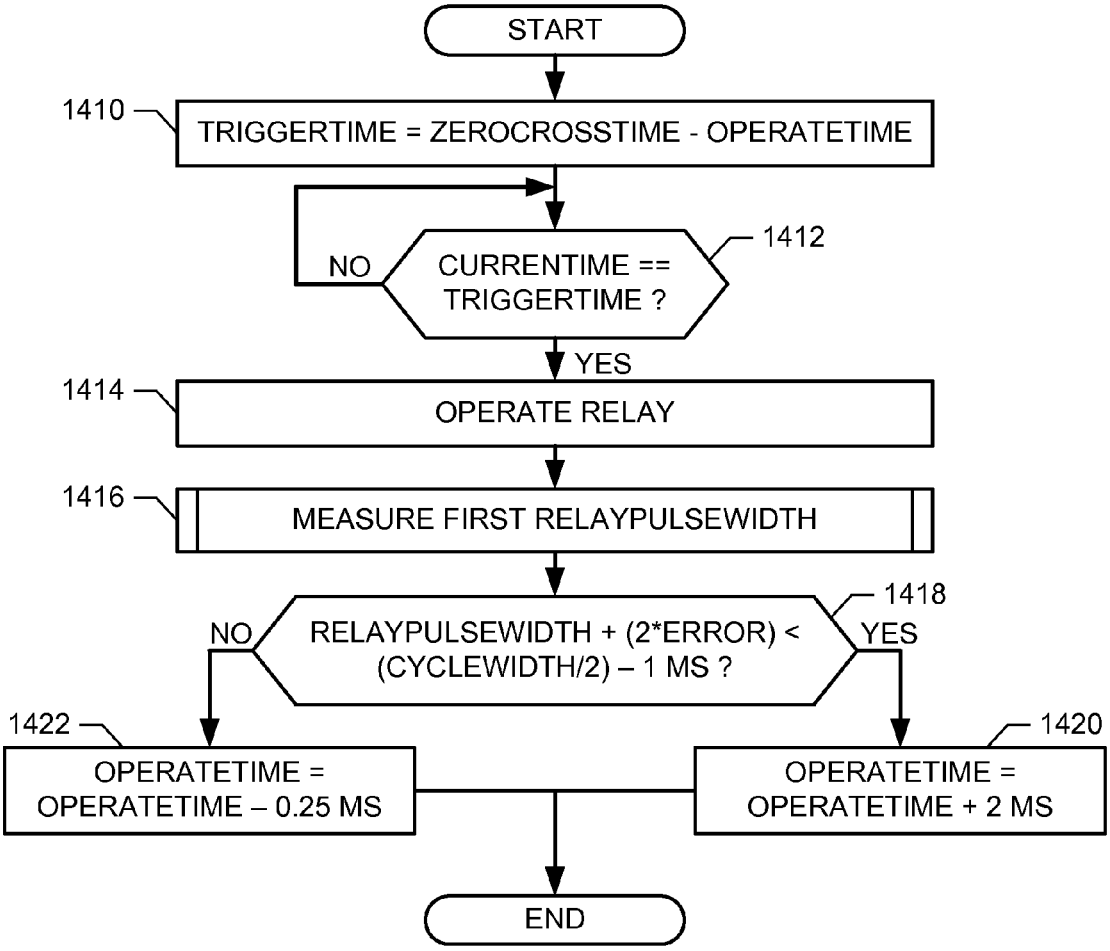
FIG. 14 is a flowchart illustrating an example method that may be performed to update relay operate time during operation.
Figure 15:
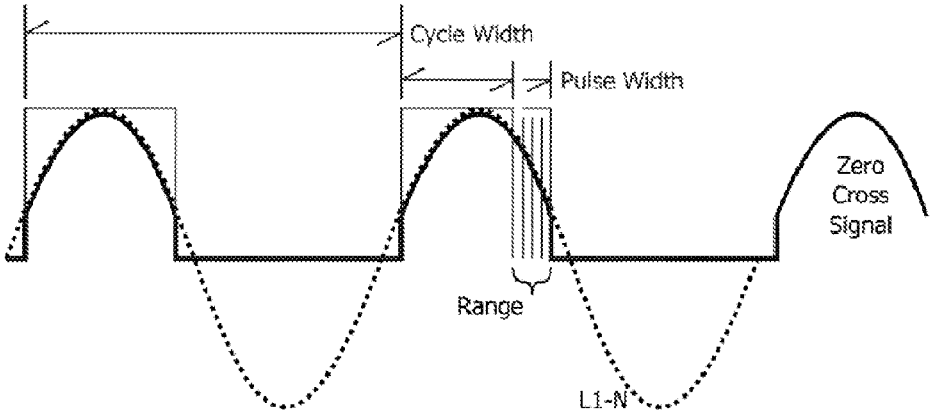
FIG. 15 is a graph depicting example updates of relay release times during operation.

FIG. 14 is a flowchart illustrating an example method that may be performed or carried out by, for example, the processor 36, to adaptively adjust relay operate trigger time. The method of FIG. 14 begins with the processor 36 setting TRIGGERTIME (block 1410). When TRIGGERTIME is reached (block 1412), the processor 36 operates the relay 212 (i.e., sends a relay operate switching signal to the relay) (block 1414), and measures the width of the first pulse following the relay operate switching signal (block 1416). If OPERATETIME results in a measured RELAYPULSEWIDTH corresponding to the closure occurring too far before the zero-cross (block 1418), where ERROR is determined using the example method of FIG. 4, the processor 36 increments OPERATETIME by, for example, 2 ms (block 1420). If OPERATETIME results in a measured RELAYPULSEWIDTH corresponding to the closure straddling the zero-cross (block 1418), the processor 36 decrements OPERATETIME by, for example, 0.25 ms (block 1422). OPERATETIME is decremented at block 1422 to enable future closures to facilitate updates of OPERATETIME, as needed.

For relay release, the process uses a modified line-straddling algorithm to adapt relay release switching times so that relay contacts open 1-2 ms before zero-cross. If the relay contacts are opened too early, the time at which the next corresponding relay release switch signal is sent to the relay 212 is moved forward in time with respect to zero-cross. Thus, the relay release trigger time will progressively move forward in time until the relay 212 open occurs 1-2 ms before zero-cross.

Figure 16:
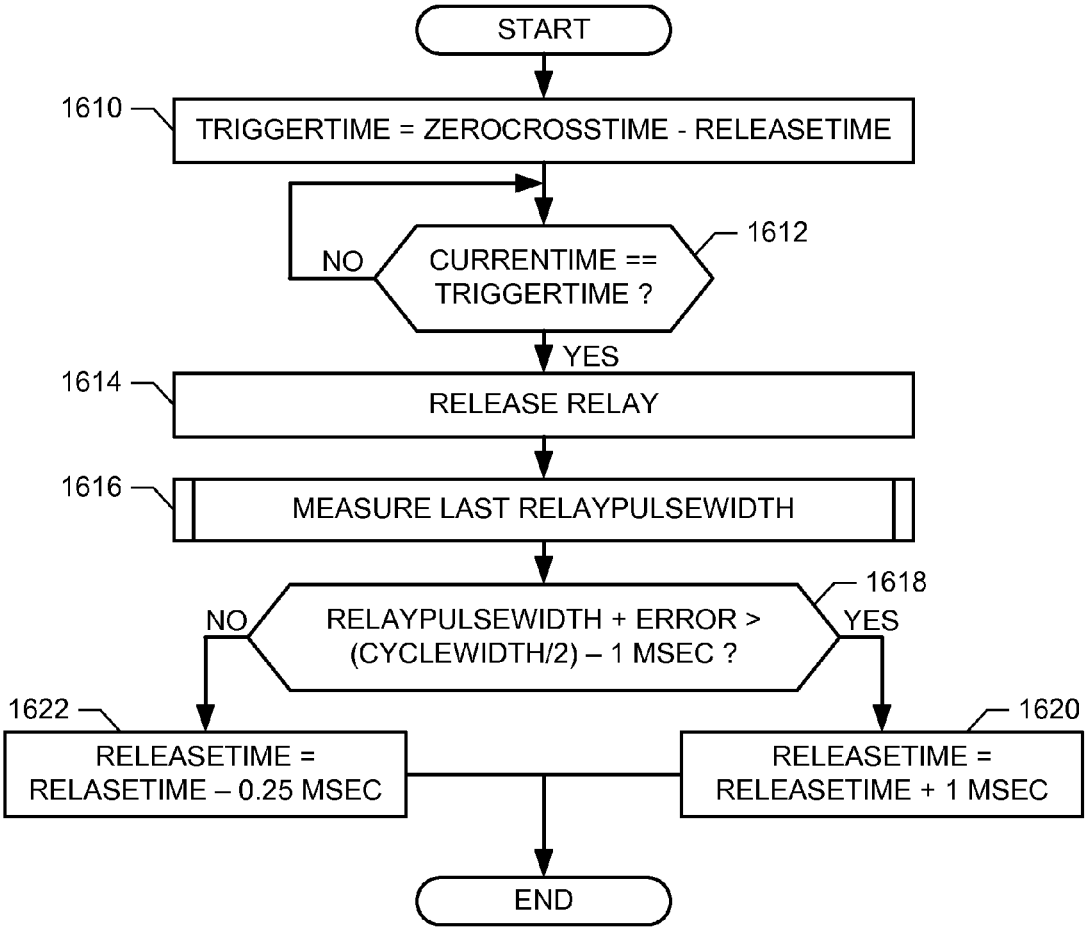
FIG. 16 is a flowchart illustrating an example method that may be performed to update relay release time during operation.

FIG. 16 is a flowchart illustrating an example method that may be performed and/or carried out by, for example, the processor 36, to adaptively adjust relay release trigger time. The method of FIG. 16 begins with the processor 36 setting TRIGGERTIME (block 1610). When TRIGGERTIME is reached (block 1612), the processor 36 releases the relay (i.e., sends a relay release switching signal to the relay 212) (block 1614), and measures the width of the pulse preceding the relay switching signal (block 1616). If RELEASETIME results in a measured RELAYPULSEWIDTH corresponding to the release occurring too far ahead of zero-cross (block 1618), where ERROR is determined using the example method of FIG. 4, the processor 36 increments RELEASETIME by, for example, 1 ms (block 1620). If RELEASETIME results in a measured RELAYPULSEWIDTH corresponding to the release being too close to zero-cross (block 1618), the processor 36 decrements RELEASETIME by, for example, 0.25 ms (block 1622).

Figure 17:
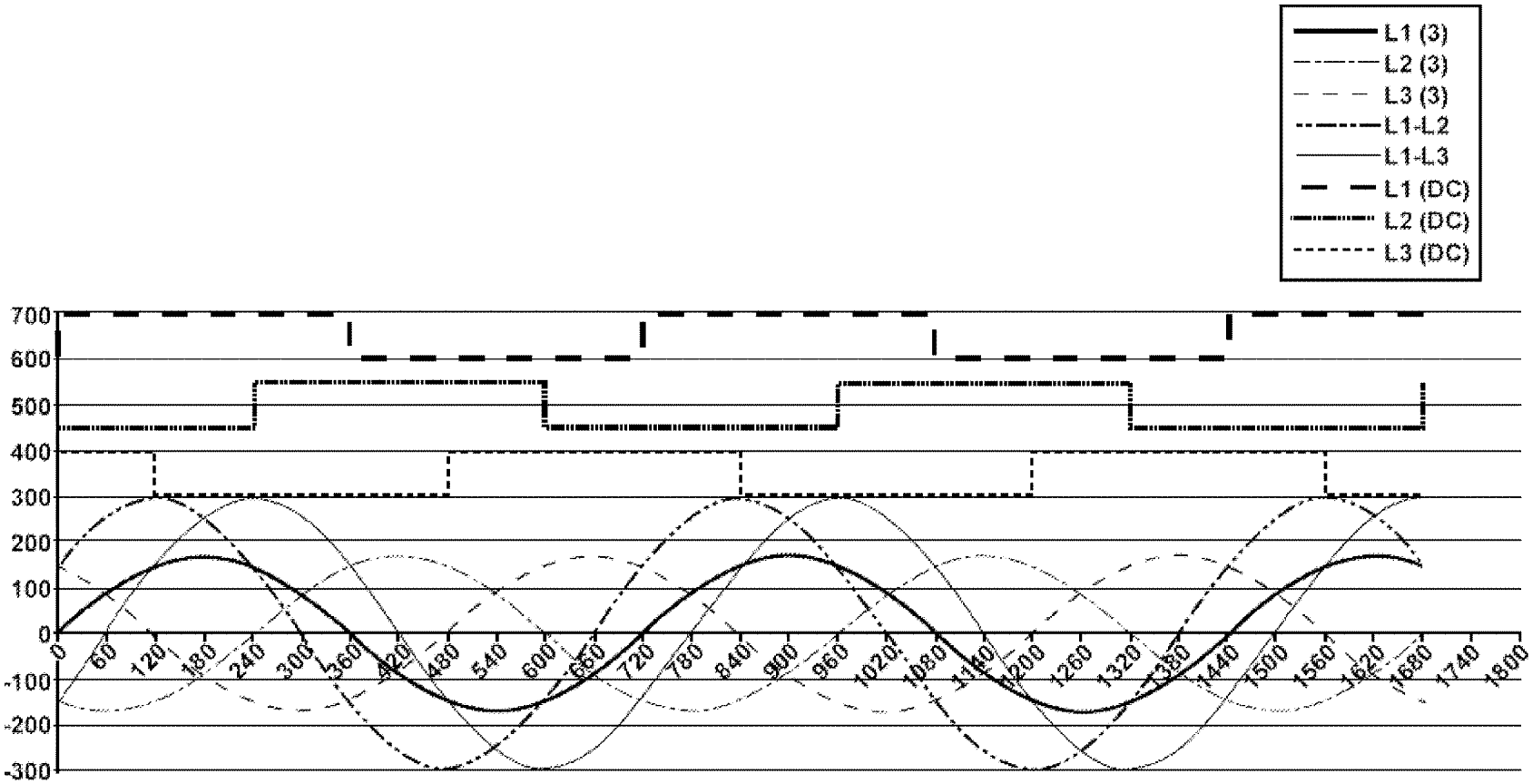
FIG. 17 is a graph depicting example relationships between leads of a split-phase or a three-phase AC power source.

FIG. 17 is a graph illustrating relationships between different phases of a split-single phase and a three-phase power supply. In contrast to split-single phase systems, in a three-phase system, zero crossings at the load (L1–L2) do not coincide with zero crossings of the L1–N and L2–N inputs, as shown in FIG. 17.

Figure 18:
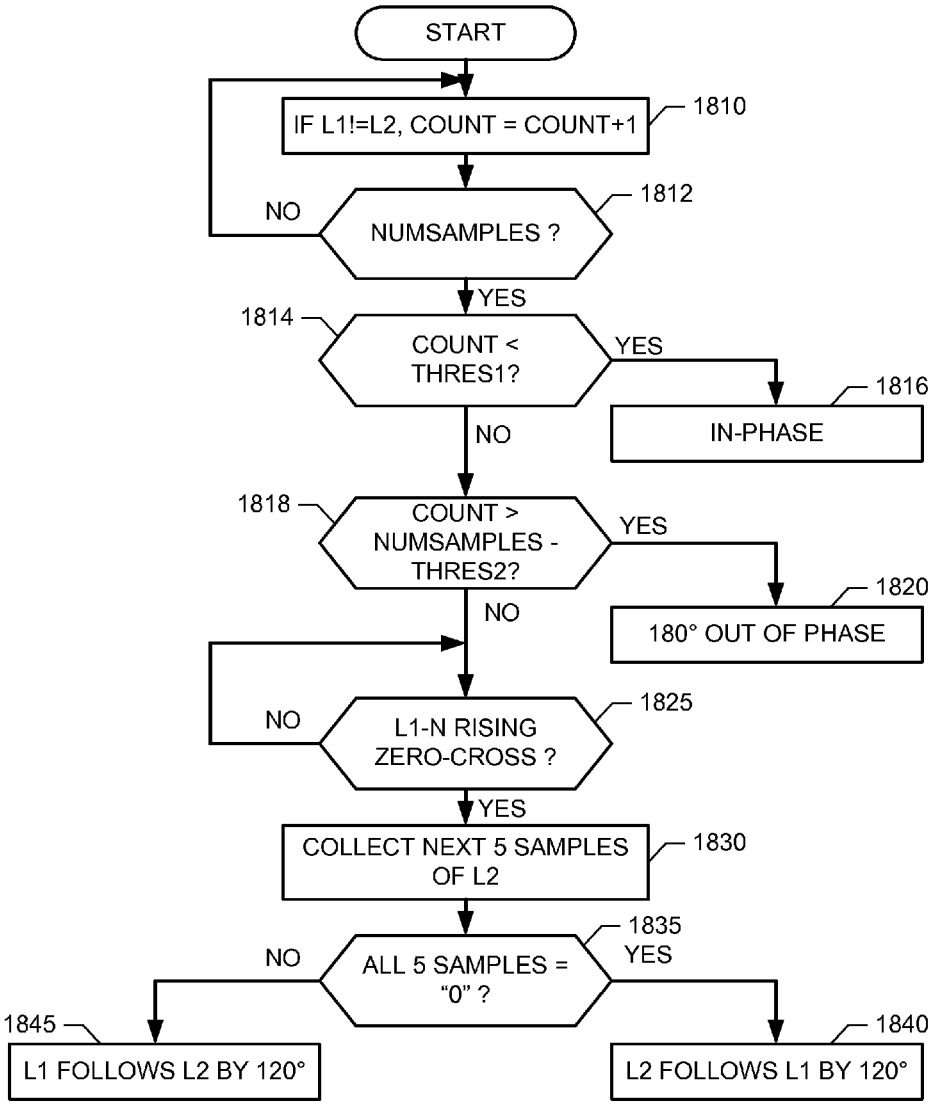
FIG. 18 is a flowchart illustrating an example method of determining phase relationships between input lines.

FIG. 18 is a flowchart illustrating an example method that may be performed and/or carried out by, for example, the processor 36, to detect relationships between the L1 and L2 inputs. The example method of FIG. 18 begins with the processor 36 counting the number of times (COUNT) in NUMSAMPLES samples that reference signal 226 (L1–N) does not equal reference signal 228 (L2–N) (blocks 1810 and 1812). If COUNT is less than a threshold THRES1 (block 1814), then the processor 36 determines that L1 and L2 are in-phase (block 1816), and control exits from the example method of FIG. 18. An example value of THRES1 is 6, when the sampling rate is 4 kHz, NUMSAMPLES is 200, and the frequency of the AC voltage supply is 60 Hz.

If COUNT is greater than another threshold THRES2 (block 1818), then the processor 36 determines that L1 and L2 are 180° out-of-phase (block 1820), and control exits from the example method of FIG. 18. An example value of THRES2 is 194, when the sampling rate is 4 kHz, NUMSAMPLES is 200, and the frequency of the AC voltage supply is 60 Hz.

IF COUNT is between THRES1 and THRES2 (block 1818), the processor 36 waits for the next rising zero-cross of L1–N (block 1825), and then collects the next five (5) samples of reference signal 228 (L2–N) (block 1830). If all 5 samples are zero (0) (block 1835), the processor 36 determines that L2 follows L1 by 120° (block 1840), and control exits from the example method of FIG. 18. Otherwise, the processor 36 determines that L1 follows L2 by 120° (block 1840), and control exits from the example method of FIG. 18.

Knowing the phase relationship between L1 and L2, the processor 36 can determine zero-crossings of the L1–L2 voltage at the load 224 based on zero-crossings of L1–N. When in-phase, zero-cross of L1–L2 corresponds to zero-cross of L1–N. When 180° out of phase, zero-cross of L1–L2 precedes L1–N zero-cross by 90°. When L2 follows L1 by 120°, then zero-cross of L1–L2 precedes L1–N zero-cross by 30°, and when L1 follows L2 by 120°, then zero-cross of L1–L2 lags behind L1–N zero-cross by 30°. Using these adjustments, the processor 36 can maintain relay switching times based on the reference signal 226 (L1–N) and corresponding sensor signal 230, and adjust OPERATETIME and RELEASTTIME to accommodate the phase relationship.

The example methods shown in FIGS. 4, 8, 12, 14, 16 and 18 may, for example, be implemented as machine-readable instructions carried out by one or more processors to implement the example controller 36 of FIGS. 1 and 2. A processor, a controller and/or any other suitable processing device may be used, configured and/or programmed to execute and/or carry out the example methods of FIGS. 4, 8, 12, 14, 16 and 18. For example, the example methods of FIGS. 4, 8, 12, 14, 16 and 18 may be embodied in program code and/or machine-readable instructions stored on a tangible and/or non-transitory computer-readable medium accessible by a processor, a computer and/or other machine having a processor such as the example processor platform P100 of FIG. 19. Machine-readable instructions comprise, for example, instructions that cause a processor, a computer and/or a machine having a processor to perform one or more particular processes. Alternatively, some or all of the example methods of FIGS. 4, 8, 12, 14, 16 and 18 may be implemented using any combination(s) of fuses, application-specific integrated circuit(s) (ASIC(s)), programmable logic device(s) (PLD(s)), field-programmable logic device(s) (FPLD(s)), field programmable gate array(s) (FPGA(s)), discrete logic, hardware, firmware, etc. Also, some or all of the example methods of FIGS. 4, 8, 12, 14, 16 and 18 may be implemented using any combination of any of the foregoing techniques, for example, any combination of firmware, software, discrete logic and/or hardware. Further, many other methods of implementing the example methods of FIGS. 4, 8, 12, 14, 16 and 18 may be employed. For example, the order of execution may be changed, and/or one or more of the blocks and/or interactions described may be changed, eliminated, sub-divided, or combined. Additionally, any or the entire example methods of FIGS. 4, 8, 12, 14, 16 and 18 may be carried out sequentially and/or carried out in parallel by, for example, separate processing threads, processors, devices, discrete logic, circuits, etc.

As used herein, the term "computer-readable medium" is expressly defined to include any type of computer-readable medium and to expressly exclude propagating signals. Example computer-readable medium include, but are not limited to, a volatile and/or non-volatile memory, a volatile and/or non-volatile memory device, a compact disc (CD), a digital versatile disc (DVD), a read-only memory (ROM), a random-access memory (RAM), a programmable ROM (PROM), an electronically-programmable ROM (EPROM), an electronically-erasable PROM (EEPROM), an optical storage disk, an optical storage device, a magnetic storage disk, a magnetic storage device, a cache, and/or any other storage media in which information is stored for any duration (e.g., for extended time periods, permanently, brief instances, for temporarily buffering, and/or for caching of the information) and that can be accessed by a processor, a computer and/or other machine having a processor, such as the example processor platform P100 discussed below in connection with FIG. 19.

FIG. 19 illustrates an example processor platform P100 capable of executing, performing and/or otherwise carrying out the example methods of FIGS. 4, 8, 12, 14, 16 and 18 to implement the example controller 36 of FIGS. 1 and 2. The example processor platform P100 can be, for example, any type of computing device containing a processor.

The processor platform P100 of the instant example includes at least one programmable processor P105. For example, the processor P105 can be implemented by one or more Atmel®, Intel®, AMD®, and/or ARM® microprocessors. Of course, other processors from other processor families and/or manufacturers are also appropriate. The processor P105 executes coded instructions P110 present in main memory of the processor P105 (e.g., within a volatile memory P115 and/or a non-volatile memory P120), stored on a storage device P150, stored on a removable computer-readable storage medium P155 such as a CD, a DVD and/or a FLASH drive. The processor P105 may execute, among other things, the example methods of FIGS. 4, 8, 12, 14, 16 and 18. Thus, the coded instructions P110 may include instructions corresponding to the example methods of FIGS. 4, 8, 12, 14, 16 and 18.

The processor P105 is in communication with the main memory including the non-volatile memory P120 and the volatile memory P115, and the storage device P150 via a bus P125. The volatile memory P115 may be implemented by, for example, synchronous dynamic random access memory (SDRAM), dynamic random access memory (DRAM), RAMBUS® dynamic random access memory (RDRAM) and/or any other type of RAM device(s). The non-volatile memory P120 may be implemented by, for example, flash memory(-ies), flash memory device(s) and/or any other desired type of memory device(s). Access to the memory P115 and P120 may be controlled by a memory controller.

The processor platform P100 also includes an interface circuit P130. Any type of interface standard, such as an external memory interface, serial port, general-purpose input/output, as an Ethernet interface, a universal serial bus (USB), and/or a peripheral component interface (PCI) express interface, etc, may implement the interface circuit P130.

One or more input devices P135 are connected to the interface circuit P130. The input device(s) P135 permit a user to enter data and commands into the processor P105. The input device(s) P135 can be implemented by, for example, the knobs 30, the control area(s) 32, a keyboard, a mouse, a touchscreen, a track-pad, a trackball, an isopoint and/or a voice recognition system. The input device(s) P135 may also implement the reference circuits 220, 222 and/or the sensor circuits 216, 218, One or more output devices P140 are also connected to the interface circuit P130. The output devices P140 can be implemented, for example, by display devices (e.g., a display, indicators, light emitting diodes, and/or speakers) to implement, for example, the display area(s) 34. The output devices P140 may also include the relays 212, 214.

The interface circuit P130 may also includes one or more communication device(s) P145 such as a network interface card to facilitate exchange of data with other appliances, devices, computers, nodes and/or routers of a network.

Although certain example methods, apparatus and articles of manufacture have been described herein, the scope of coverage of this patent is not limited thereto. On the contrary, this patent covers all methods, apparatus and articles of manufacture fairly falling within the scope of the claims of this patent.

What is claimed is:

1. A method for regulating switching times of a relay having a pair of contacts to selectively and electrically couple an analog alternating current (AC) power source and a load, the method comprising:

forming a digital pulse train representative of an AC signal at the load;

determining a first value corresponding to a representative pulse width of the digital pulse train;

providing a first relay switching signal to the relay at a first time relative to a zero crossing of the AC signal;

selecting a second time for providing a second relay switching signal to the relay based on the first value and a second value representative of the width of a first pulse of the digital pulse train associated with the first relay switching signal at the first time; and providing the second relay switching signal to the relay at the second time.

2. A method as defined in claim 1, wherein selecting the second time is based on a comparison on the first and second values.

3. A method as defined in claim 1, wherein the first value comprises an average pulse width.

4. A method as defined in claim 1, wherein the first value comprises a running average pulse width.

5. A method as defined in claim 1, wherein the second time is selected according to a predetermined increment.

6. A method as defined in claim 1, wherein providing the second relay switching signal to the relay at the second time is to effect a switching of the relay at a desired third time relative to the zero crossing.

7. A method as defined in claim 1, wherein determining the first value representative of the average pulse width of the digital pulse train comprises:

computing two or more counts of samples between rising and falling edges of respective ones of two or more pulses of the digital pulse train; and computing the first value as an average of the two or more sample counts.

8. A method as defined in claim 1, wherein the second time is selected based on an estimated switching time of the relay to effect the width of a second pulse of the digital pulse train to be approximately half the value, and further comprising:

determining a third value representative of the width of the second pulse; and selecting a third switching time for providing a third relay switching signal to the relay based on a comparison of the first and third values.

9. A method as defined in claim 1, wherein the first relay switching signal is to electrically connect the power supply and the load.

10. An apparatus comprising:

a relay controllable to selectively and electrically couple an alternating current (AC) power source and a load;

a sensing circuit to form a digital pulse train representative of an AC signal at the load; and a computing unit configured to regulate switching times of the relay by:

determining a first value representative of an average pulse width of the digital pulse train;

providing a first relay switching signal to the relay at a first time relative to a zero crossing of the AC signal;

determining a second value representative of the width of a first pulse of the digital pulse train associated with the first relay switching signal at the first time;

selecting a second time for providing a second relay switching signal to the relay based on a comparison of the first and second values; and providing the second relay switching signal to the relay at the second time.

11. An apparatus as defined in claim 10, wherein the computing unit comprises:

a processor; and a tangible article of manufacture storing machine-readable instructions that, when executed, cause the processor to determine the value, provide the first relay switching signal, and select the second time; and the sensing circuit comprises a comparator.

12. An apparatus as defined in claim 10, wherein the computing unit determines the first value as a running average pulse width.

13. An apparatus as defined in claim 10, wherein the computing unit selects the second time according to a predetermined increment.

14. An apparatus as defined in claim 10, wherein the computing unit provides the first relay switching signal to the relay at the first time to effect a switching of the relay at a desired third time relative to the zero crossing.

15. An apparatus as defined in claim 10, wherein the computing unit determines the first value representative of the average pulse width of the digital pulse train by at least:

computing two or more counts of samples between rising and fallings edges of respective ones of two or more pulses of the digital pulse train; and computing the first value as an average of the two or more sample counts.

16. An apparatus as defined in claim 10, wherein the computing unit:

selects the second time based on an estimated switching time of the relay to effect the width of a second pulse of the digital pulse train to be approximately half the value;

determines a third value representative of the width of the second pulse; and selects a third switching time for providing a third relay switching signal to the relay based on a comparison of the first and third values.

17. An apparatus as defined in claim 10, wherein the computing unit sends the first relay switching signal to the relay to electrically disconnect the power supply and the load.

18. A non-transitory tangible article of manufacturing storing machine-readable instructions that, when executed, cause a machine to at least:

receive from a circuit a digital pulse train representative of an alternating current (AC) signal at a load selectively and electrically coupled to an AC power source via a relay;

determine a first value representative of an average pulse width of the digital pulse train;

provide a first relay switching signal to the relay at a first time relative to a zero crossing of the AC signal;

select a second time for providing a second relay switching signal to the relay based on a comparison of the first value and a second value representative of the width of a first pulse of the digital pulse train associated with the first relay switching signal at the first time; and provide the second relay switching signal to the relay at the second time.

* * * * *